US008800522B2

(12) United States Patent
Sengebusch

(10) Patent No.: US 8,800,522 B2
(45) Date of Patent: Aug. 12, 2014

(54) METHOD AND DEVICE FOR CONTROLLING A STOP-START PROGRAM

(75) Inventor: Falco Sengebusch, Stuttgart-Feuerbach (DE)

(73) Assignee: Robert Bosch GmbH, Stuttgart (DE)

( * ) Notice: Subject to any disclaimer, the term of this patent is extended or adjusted under 35 U.S.C. 154(b) by 276 days.

(21) Appl. No.: 13/393,474

(22) PCT Filed: Aug. 26, 2010

(86) PCT No.: PCT/EP2010/062425

§ 371 (c)(1),
(2), (4) Date: May 12, 2012

(87) PCT Pub. No.: WO2011/026773

PCT Pub. Date: Mar. 10, 2011

(65) Prior Publication Data

US 2012/0216769 A1 Aug. 30, 2012

(30) Foreign Application Priority Data

Sep. 4, 2009 (DE) ..... 10 2009 029 210

(51) Int. Cl.
*F02N 11/06* (2006.01)
*F02N 11/14* (2006.01)

(52) U.S. Cl.
USPC ..... 123/179.3; 701/113

(58) Field of Classification Search
USPC ..... 123/179.3, 179.28, 179.25, 179.1; 701/113; 73/114.59, 114.77
See application file for complete search history.

(56) References Cited

U.S. PATENT DOCUMENTS

| | | | | |
|---|---|---|---|---|
| 5,743,227 | A * | 4/1998 | Jacquet et al. | 123/179.3 |
| 5,905,315 | A * | 5/1999 | Lefebvre et al. | 307/10.6 |
| 6,732,043 | B2 * | 5/2004 | Schoch | 701/113 |
| 2002/0082765 | A1 * | 6/2002 | Schoch | 701/113 |

FOREIGN PATENT DOCUMENTS

| | | |
|---|---|---|
| DE | 10 2005 021 227 | 11/2006 |
| DE | 10 2006 011 644 | 9/2007 |
| DE | 10 2006 039 112 | 2/2008 |

OTHER PUBLICATIONS

International Search Report for PCT/EP2010/062425, dated Jan. 5, 2011.

* cited by examiner

*Primary Examiner* — Mahmoud Gimie
(74) *Attorney, Agent, or Firm* — Kenyon & Kenyon LLP

(57) ABSTRACT

A starter is supplied with current for a certain current feed duration during meshing of a starter pinion of the starter with a coasting internal combustion engine. The current feed is shut down after reaching the certain current feed duration and an induced voltage is measured. The measured induced voltage is compared with a reference voltage and the current feed duration for a subsequent current feed is set as a function of the comparison result.

10 Claims, 2 Drawing Sheets

METHOD AND DEVICE FOR CONTROLLING A STOP-START PROGRAM

BACKGROUND OF THE INVENTION

1. Field of the Invention

The present invention relates to starter systems in motor vehicles.

2. Description of Related Art

For driving an internal combustion engine from a standstill, starter systems which usually have an electric motor for driving the internal combustion engine are used in automotive drives. The internal combustion engine is usually started here with the aid of a starter using an electric motor and a starter pinion, which meshes with an annular gear of the internal combustion engine. In addition to traditional starters having a starter pinion, belt starters, integrated starters, and hybrid drives having a shiftable clutch between the electric motor and the internal combustion engine are known.

In the case of a starter having a starter pinion, which is known internally to the applicant, the pinion is synchronized only with the rotational speed of the coasting internal combustion engine. On achieving synchronized running, the pinion meshes with the rotating annular gear to achieve a rapid restart when the internal combustion engine is coasting. The most accurate possible synchronization is important to minimize wear and noise emission.

BRIEF SUMMARY OF THE INVENTION

The present invention is based on the finding that there is a certain relationship between the rotational speed of the starter and the crank time or the current feed duration and that the instantaneous starter rotational speed of the starter may be inferred from a voltage induced at the end of the current feed to ramp up the starter, when its rotational speed is increased. The relationship mentioned above between the crank time and the rotational speed may be ascertained through various measurements of the ramp-up rotational speed in relation to the current feed duration of the starter under standard conditions. The standard conditions or reference data thereby ascertained are preferably stored in a lookup table.

However, since it is to be expected that in special application cases, the boundary conditions which influence the starter rotational speed may deviate significantly from standard conditions, it is provided according to the present invention that the standard conditions are to be corrected on the basis of the instantaneously measured induced voltage or on the basis of the instantaneous starter rotational speed calculated with the aid of the measured induced voltage.

Parameters which may bring about these deviations include the internal resistance and the voltage of the battery, the resistances due to the cabling to the starter and the resistances in the starter itself. There may therefore be a not-insignificant deviation in the actual starter rotational speed from the rotational speed stored in the lookup table. According to the present invention, however, the standard conditions, in particular the stored current feed duration, may be adapted as a function of the instantaneously measured induced voltage. Noise emission, wear and even damage to the pinion and the annular gear may thus be minimized or prevented according to the present invention.

Another advantage is that the voltage measurement is usually much more accurate than a current measurement. A calculation error, which might result due to the tolerance in the current measurement, may thus be compensated advantageously.

Accordingly, a method is proposed for setting a current feed duration for supplying current to a starter of a starter system, for example, of a start-stop system, including the steps of supplying current to the starter for a certain current feed duration during meshing of a starter pinion of the starter with a coasting internal combustion engine, shutting down the current feed on reaching the certain current feed duration and the measurement of an induced voltage thereby, as well as the comparison of the measured induced voltage with a reference voltage and the setting of the current feed duration, which depends on same. Setting the current feed duration includes in particular correcting the current feed duration for the next time.

In addition, a computer program product is proposed, which causes the method according to the present invention for setting a current feed duration for supplying current to a starter of a starter system to be performed on a program-controlled device.

A computer program product such as a computer program means may be provided or supplied as a memory medium such as a memory card, USB stick, floppy, CD-ROM, DVD or even in the form of a downloadable file from a server in a network, for example. This may be accomplished, for example, in a wireless communication network through the transmission of a corresponding file with the computer program product or the computer program means.

In addition, a device is proposed for setting a current feed duration for supplying current to a starter of a starter system, for example, of a start-stop system. This device has a current feed means for supplying current to the starter during meshing of a starter pinion of the starter with a coasting internal combustion engine for a certain current feed duration, shutdown means for shutting down the current feed on reaching the certain current feed duration, a measuring means for measuring a voltage induced during shutdown of the current feed, a comparison means for comparing the measured induced voltage and a reference voltage and a setting means for setting the current feed duration as a function of this comparison.

The respective means, in particular the current feed means, the shutdown means, the measuring means, the comparison means and the setting means may be implemented through hardware or software. In a hardware implementation, the respective means may be designed as a device, for example, as a computer or a microprocessor, a device or also as part of a system, for example, as a computer system. In the case of a software implementation, the respective means may be designed as a computer program product, as a function, as a routine, as part of program code or as an executable object.

Furthermore, a starter system is proposed having a device according to the present invention as explained above for setting a current feed duration for supplying current to a starter of the starter system, for example, of a start-stop system, of a vehicle drive.

In the sense of the present patent application, a vehicle may be a passenger vehicle, a truck, a commercial vehicle or a motorcycle.

According to a preferred refinement, a rotational speed of the starter is ascertained as a function of the measured induced voltage.

The standard conditions, in particular the stored current feed duration, may therefore advantageously be adapted as a function of the instantaneously ascertained rotational speed or starter rotational speed.

According to another preferred refinement, the ascertained rotational speed is compared with a reference rotational speed and the current feed duration is set as a function of same. The respective current feed duration may thus be adjusted adaptively.

According to another preferred refinement, the meshing with the coasting internal combustion engine is aborted if the ascertained rotational speed is greater than an upper rotational speed threshold value.

Various factors may result in the starter actually being faster after the current feed duration stored in the lookup table has been applied and thus selected. Such factors include, for example, a low-impedance vehicle electrical system, a low-impedance battery or low-impedance brush resistors and copper resistors in the starter. If the starter is then in fact faster than expected, it will also induce a higher voltage after the end of the current feed and after shutdown of the current feed. Depending on the excess rotational speed, the current feed duration may be reduced with the next current feed.

In the event of a too high rotational speed excess which is detected, if the ascertained rotational speed is greater than a certain upper rotational speed threshold value, the meshing with the coasting internal combustion engine is aborted. Instead meshing to a standstill is carried out to prevent excessive noise emission and high wear.

According to another preferred refinement, the starter pinion is pre-meshed later in the next starting operation if the ascertained rotational speed is below a lower rotational speed threshold value.

If the starter is currently too slow because the vehicle electrical system, the battery or the starter has a higher impedance than expected, the trigger time or current feed duration may be lengthened for the next current feed. Furthermore, the starter pinion may advantageously be pre-meshed somewhat later than originally planned according to the lookup table in order to be synchronized with an appropriately lower engine rotational speed.

According to another preferred refinement, a lookup table is provided in which a correlation of the reference rotational speed of the starter to the current feed duration is stored.

The example of the lookup table is the simplest option for storing the corresponding reference rotational speed and the corresponding current feed duration in a correlated manner. This yields a rapid comparison during operation.

According to another preferred refinement, the corresponding current feed duration correlated to the corresponding reference rotational speed is set as a function of the comparison between the ascertained rotational speed and the corresponding reference rotational speed.

This advantageously yields a simple and organized storage option of the reference rotational speed and the correlated current feed duration.

Furthermore, a method for supplying current to a starter of a starter system, for example, of a start-stop system, is proposed. This method includes the steps of setting a current feed duration for supplying current to the starter of the starter system according to the method explained above and supplying current to the starter for the set current feed duration.

In addition, a configuration for supplying current to a starter of a starter system, for example, of a start-stop system, is proposed. This configuration has the device mentioned above for setting a current feed duration for supplying current to the starter and a current feed means for supplying current to the starter for the set current feed duration.

In addition, a starter system is proposed having a starter and the configuration explained above for supplying current to the starter.

DETAILED DESCRIPTION OF THE INVENTION

Figure 1:
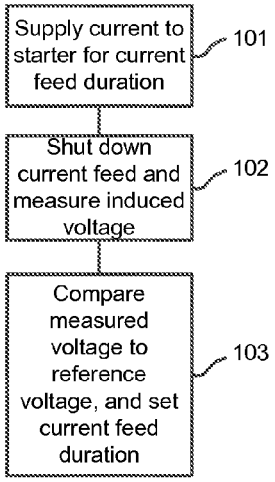
FIG. 1 shows a schematic flow chart of a method for setting a current feed duration for supplying current to a starter of a starter system.

FIG. 1 shows a schematic flow chart of a first exemplary embodiment of the method according to the present invention for setting a current feed duration for supplying current to a starter of a starter system. The first exemplary embodiment according to FIG. 1 has method steps 101 through 103. In method step 101, current is supplied to the starter for a certain current feed duration during meshing of a starter pinion of the starter with a coasting internal combustion engine. In method step 102, the current feed is shut down on reaching the certain current feed duration and the induced voltage is then measured. The induced voltage is measured on terminal 45 of the starter in particular.

In method step 103, the measured induced voltage is compared with a reference voltage in particular and the current feed duration is set, depending on the result. The engine is revved up for a certain current feed duration, for example for x ms, because a certain rotational speed is expected after this current feed duration. After the current feed has stopped, the voltage is measured and it is checked whether or not the correct speed has been reached. The crank time is adjusted if necessary (adjustment or scaling of the reference line).

Figure 2:
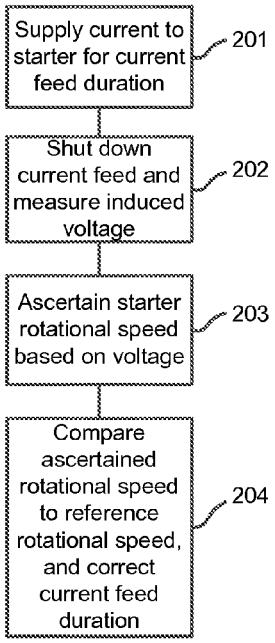
FIG. 2 shows a schematic flow chart of a method for setting a current feed duration for supplying current to a starter of a starter system.

FIG. 2 shows a schematic flow chart of a second exemplary embodiment for setting a current feed duration for supplying current to a starter of a starter system including method steps 201 through 204.

In method step 201, the starter is supplied with current for a certain current feed duration during meshing of a starter pinion of the starter with a coasting internal combustion engine. In method step 202 the current feed is shut down on reaching the certain current feed duration and the induced voltage is measured.

In method step 203, a rotational speed of the starter is ascertained as a function of the measured induced voltage.

In method step 204, the ascertained rotational speed is compared with a reference rotational speed, and the current feed duration in the reference table is corrected as a function of the result.

A lookup table (LUT) is provided in which a correlation of the reference rotational speed of the starter with the current feed duration is stored. In such a case, the corresponding current feed duration correlating with the corresponding reference rotational speed is set as a function of the comparison between the ascertained rotational speed and the corresponding reference rotational speed.

Figure 3:
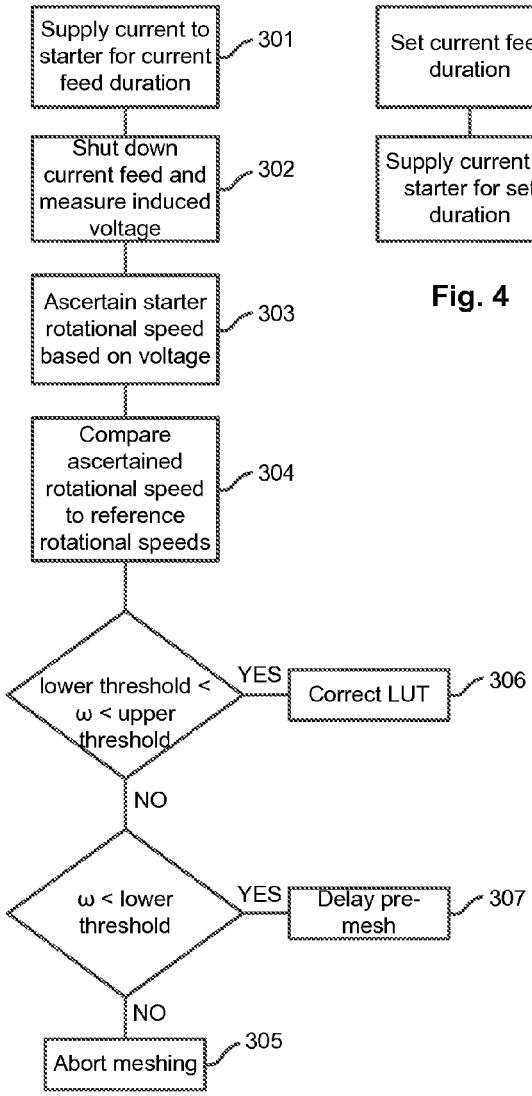
FIG. 3 shows a schematic flow chart of a method for setting a current feed duration for supplying current to a starter of a starter system.

FIG. 3 shows a schematic flow chart of a third exemplary embodiment of the method according to the present invention for setting a current feed duration for supplying current to a starter of a starter system, which has method steps 301 through 307. Method steps 301 through 303 of FIG. 3 correspond to method steps 201 through 203 in FIG. 2, which will not be explained here again to avoid repetition.

Method steps 304 through 307 are performed as a function of the rotational speed of the starter, which is ascertained in method step 303 as a function of the measured induced voltage.

In method step 304, the ascertained rotational speed is compared with reference rotational speeds, in particular with an upper rotational speed threshold value and with a lower rotational speed threshold value.

If the ascertained rotational speed is greater than the upper rotational speed threshold value, then the meshing with the coasting internal combustion engine is aborted in a method step 305. Furthermore, the crank time is corrected for the next time. The correction is preferably stored in the lookup table.

If the ascertained rotational speed is in a tolerance range, in particular between the upper rotational speed threshold value and the lower rotational speed threshold value, then the lookup table is corrected, if necessary, in method step 306.

If the ascertained rotational speed is lower than the lower rotational speed threshold value, then, in method step 307, the starter pinion is pre-meshed later than planned in order to be synchronized with an appropriately lower engine rotational speed. Furthermore, the crank time for the next time is corrected. The correction is preferably stored in the lookup table.

Figure 4:
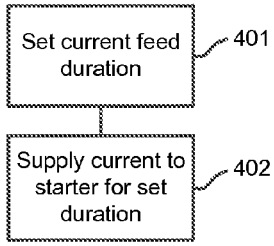
FIG. 4 shows a schematic flow chart of a method for supplying current to a starter of a starter system.

FIG. 4 shows a schematic flow chart of a method for supplying current to a starter of a starter system having method steps 401 and 402.

In method step 401, the current feed duration for supplying current to the starter of the starter system is set, for example, as shown according to an exemplary embodiment of FIGS. 1 through 3.

In method step 402, the starter is supplied with current for the current feed duration set according to method step 401.

Figure 5:
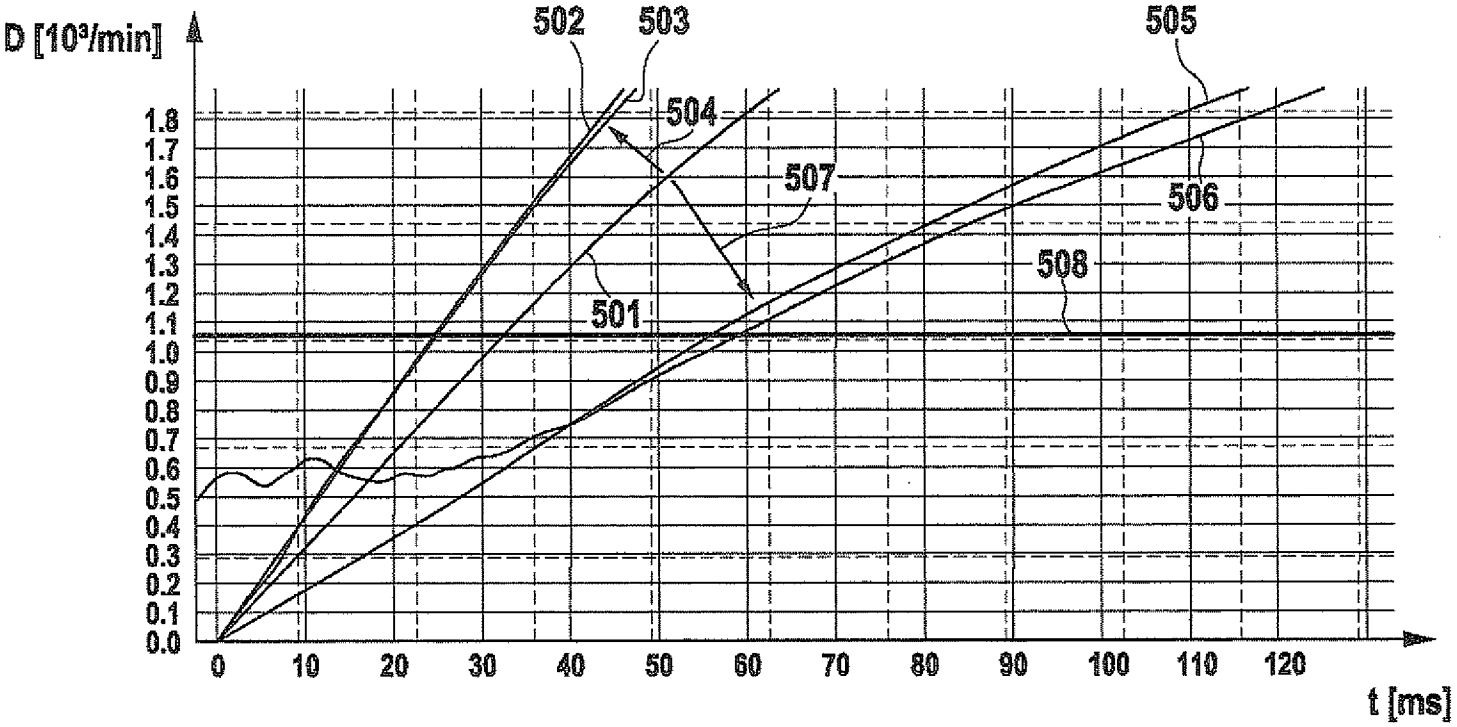
FIG. 5 shows a schematic diagram for representing the changes in a reference line with a rapidly ramping up starter and a slowly ramping up starter.

FIG. 5 shows one example of the functioning of the present invention. FIG. 5 shows a schematic t-D diagram illustrating the changes in a reference line 501 in the case of a rapidly ramping up starter and a slowly ramping up starter. In FIG. 5, t denotes the time in ms, D is the rotational speed of the starter in $10^3$/min, 501 is the reference line stored in the lookup table and 508 is the target rotational speed. Curves 502 and 503 also show examples of a rapidly ramping up starter. Arrow 504 here illustrates the bending of reference line 501 in the case of an instantaneously fast ramping up starter toward the D axis. Furthermore, curves 505 and 506 show examples of a slowly ramping up starter, where arrow 507 illustrates the bending of reference line 501 toward the t axis in the case of an instantaneously slowly ramping up starter.

Furthermore, the parameters or regulator parameters stored in the lookup table are differently selected in particular. An attempt is made here in particular to directly change the crank time and the current feed duration for the next current feed operation in such a way that the desired target rotational speed is reached according to FIG. 5. Major changes are thus possible from time to time and the susceptibility to boosting measuring inaccuracies during evaluation of the induced voltage may be very great. It is also conceivable to provide a limitation on the change in the current feed duration in small increments the next time. This comes closer to an approximation to a vehicle electrical system, which changes only slowly.

What is claimed is:

1. A method for controlling a current feed duration for supplying current to a starter of a starter system, comprising:

supplying current to the starter during meshing of a starter pinion of the starter with a coasting internal combustion engine for a predetermined current feed duration;

shutting down the current feed at the end of the predetermined current feed duration;

measuring a voltage induced on shutdown of the current feed; and comparing the measured induced voltage with a reference voltage and setting the current feed duration for a subsequent current feed as a function of the comparison result.

2. The method as recited in claim 1, wherein a rotational speed of the starter is ascertained as a function of the measured induced voltage.

3. The method as recited in claim 2, wherein the ascertained rotational speed is compared with a reference rotational speed, and wherein the duration for the subsequent current feed is set as a function of the result of the comparison with the reference rotational speed.

4. The method as recited in claim 3, wherein the meshing with the coasting internal combustion engine is aborted if the ascertained rotational speed is greater than a predetermined upper rotational speed threshold value.

5. The method as recited in claim 3, wherein the starter pinion is pre-meshed later if the ascertained rotational speed is less than a predetermined lower rotational speed threshold value.

6. The method as recited in claim 3, wherein a lookup table storing a correlation of the reference rotational speed of the starter with the current feed duration is provided.

7. The method as recited in claim 6, wherein the corresponding current feed duration correlated to the corresponding reference rotational speed is set as a function of the comparison between the ascertained rotational speed and the corresponding reference rotational speed.

8. A device for setting a current feed duration for supplying current to a starter of a starter system, comprising:

a current feed means for supplying current to the starter during meshing of a starter pinion of the starter with a coasting internal combustion engine for a predetermined current feed duration;

a shutdown means for shutting down the current feed at the end of the predetermined current feed duration;

a measuring means for measuring a voltage induced on shutdown of the current feed;

a comparator means for comparing the measured induced voltage with a reference voltage; and a setting means for setting the current feed duration for a subsequent current feed as a function of the comparison result.

9. A starter system, comprising:

a starter; and a device for setting a current feed duration for supplying current to the starter, the device including:

a current feed means for supplying current to the starter during meshing of a starter pinion of the starter with a coasting internal combustion engine for a predetermined current feed duration;

a shutdown means for shutting down the current feed at the end of the predetermined current feed duration;

a measuring means for measuring a voltage induced on shutdown of the current feed;

a comparator means for comparing the measured induced voltage with a reference voltage; and a setting means for setting the current feed duration for a subsequent current feed as a function of the comparison result.

10. The starter system as recited in claim 9, further comprising a current feed device for supplying current to the starter for the set current feed duration.

* * * * *